US006129869A

United States Patent [19]

Stegmeier et al.

[11] Patent Number: 6,129,869

[45] **Date of Patent: *Oct. 10, 2000**

[54] METHOD OF FORMING A RAISED GRIPPING EDGE ON POURED AGGREGATE COPING

[76] Inventors: William J. Stegmeier, 1115 Harris Rd.; John M. Stegmeier, 3302 Westgrove, both of Arlington, Tex. 76017

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,707

[22] Filed: Jun. 24, 1997

[51] Int. Cl.[7] ..... E04B 1/16

[52] U.S. Cl. ..... 264/35

[58] Field of Search ..... 264/35

[56] References Cited

U.S. PATENT DOCUMENTS

| | | | |
|---|---|---|---|
| D. 284,971 | 8/1986 | Deason | D15/136 |
| 3,072,921 | 1/1963 | Hegerfeld | 264/35 |
| 3,850,403 | 11/1974 | Stegmeier | 264/35 |
| 3,850,404 | 11/1974 | Stegmeier | 264/35 |
| 3,872,195 | 3/1975 | Stegmeier | 264/35 |
| 3,904,717 | 9/1975 | Stegmeier | 264/35 |
| 3,929,944 | 12/1975 | Oliver | 264/35 |
| 3,968,191 | 7/1976 | Stegmeier | 264/35 |
| 3,975,477 | 8/1976 | Molitor | 264/35 |
| 4,015,379 | 4/1977 | Colson, Jr. | 264/35 |
| 4,574,017 | 3/1986 | Stegmeier | 156/60 |
| 4,967,424 | 11/1990 | Stegmeier | 4/496 |
| 5,170,517 | 12/1992 | Stegmeier | 4/496 |
| 5,330,151 | 7/1994 | Boyack | 264/35 |
| 5,339,589 | 8/1994 | Thrower | 264/35 |
| 5,536,457 | 7/1996 | Topf, Jr. | 264/35 |
| 5,662,753 | 9/1997 | Loos | 264/35 |

FOREIGN PATENT DOCUMENTS

| | | | |
|---|---|---|---|
| 2748742 | 8/1978 | Germany | 264/35 |
| 0017469 | 7/1906 | United Kingdom | 264/35 |
| 966831 | 8/1964 | United Kingdom | 264/35 |

*Primary Examiner*—Karen Aftergut
*Attorney, Agent, or Firm*—Daniel Rubin

[57] ABSTRACT

Method and apparatus for forming a raised gripping surface along the peripheral edge of poured aggregate swimming pool coping. Utilized therein is a form board including a recess to form a first portion of the gripping surface and an aggregate dispensing mule to form a second portion of the gripping surface in a contiguous relation to the first portion. A finishing tool joins both portions into a combined unitized structure.

9 Claims, 3 Drawing Sheets

METHOD OF FORMING A RAISED GRIPPING EDGE ON POURED AGGREGATE COPING

BACKGROUND OF THE INVENTION

The field of art to which the invention relates comprises method and apparatus for forming a surface hand grip on poured aggregate coping cantilevered about a swimming pool.

1. Field of the Invention

A continuous nose or lip raised along the peripheral edge of coping cantilevered about a swimming pool is considered desirable as affording a reachable handgrip for swimmers particularly children. Such a configuration has long been available using precast coping.

For economic reasons, however, it has been preferred by many that pool decking including the coping be formed on site by the pouring of aggregate such as concrete. However, the use of poured aggregate heretofore has precluded the raised lip or projected nose being formed therewith along the peripheral edge of the coping. The inability to provide such a lip or nose has generally been attributed to the practice of the cement-placing crews rodding the top of the concrete form with their strike off rods when finishing concrete around the swimming pool. As a result, many states have forbidden poured cantilevered decking on public pools.

2. Description of the Prior Art

Cantilevered coping is commonly provided about the inside perimeter of a swimming pool and is typically constructed of either processed concrete slabs or of an aggregate poured on site. When poured, a form board is utilized to profile the coping as disclosed for example in U.S. Pat. No. 3,872,195. Unlike the precast coping slabs, forming the coping by pouring of aggregate has precluded forming an extension such as a raised horizontally placed lip or a vertically placed nose extending the entire peripheral edge of the coping that swimmers can grip or cling to from within the water. Such coping therefore is considered desirable as a saftey feature and is frequently a code requirement for public pools frequented by children. On the other hand, the poured aggregate coping is considered more economical yet perfectly safe for many installations where use of a raised coping lip or nose is deemed unnecessary and/or not required by law.

yet despite recognition of the foregoing, it has not been known heretofore how to form such a raised nose, lip or combination thereof along the coping edge where the coping is constructed of poured aggregate.

OBJECTS OF THE INVENTION

An object of the invention is to provide novel method and apparatus for effecting a raised lip, nose or combination thereof along the horizontal peripheral coping surface at the cantilevered edge of poured aggregate coping.

It is a further object of the invention to effect the previous object in a reliable and economical manner.

It is a still further object of the invention to construct a cantilevered coping of poured aggregate having a raised lip, nose or both along the peripheral edge that can conveniently be grasped by a swimmer in the water below.

SUMMARY OF THE INVENTION

This invention relates to forming the decking and coping for a swimming pool of poured aggregate. More specifically, the invention relates to a poured aggregate coping having a continuous gripping surface raised along the perimeter edge of the coping that can be readily grasped by a swimmer in the pool.

For achieving the foregoing, a configured form board is utilized to shape the face of the coping when poured and provides for forming a nose projection along the vertical edge facing of the coping. Operative in the alternative or in conjunction therewith is a hand displaceable hopper mule closely fitting over the form board and the already poured coping to provide a vertically raised lip along the horizontal surface end of the coping. The mule includes a vertical hopper into which poured aggregate is introduced and an underside longitudinally extending recess into which aggregate from the hopper is dispensed onto the horizontal coping underlying the mule. Longitudinally displacing the mule while continually maintaining an aggregate supply in the hopper causes the raised lip to be deposited continuously about the horizontal distal surface of the coping. Separate mules are then utilized for troweling while a finishing tool is used to eliminate any parting line and effect a seamless grasping surface of the lip and nose before the aggregate sets.

By means of the above, there is provided method and apparatus for overcoming a long standing limitation imposed on poured aggregate coping affording a safety feature previously unavailable with such copings.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
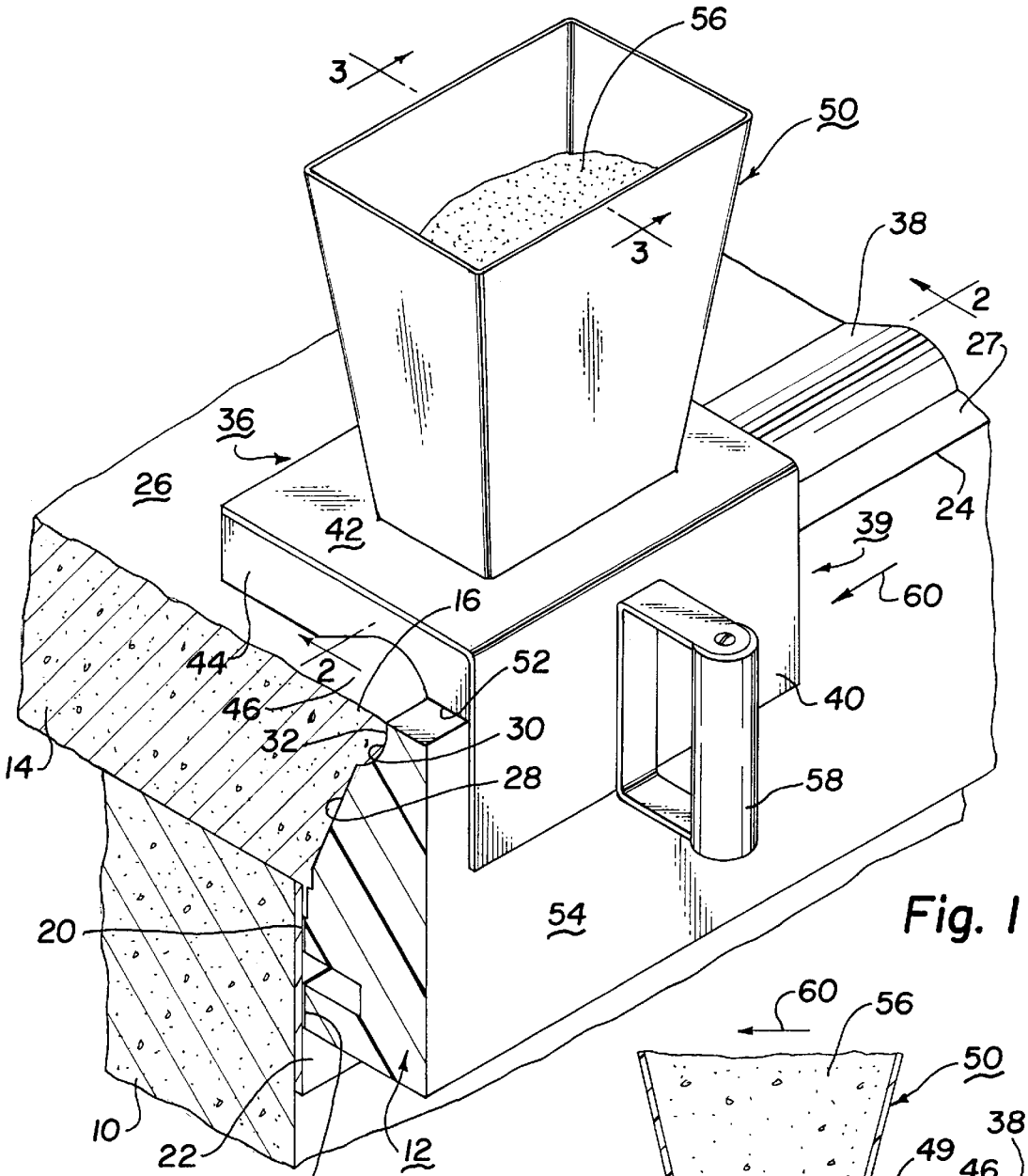
FIG. 1 is a fragmentary isometric elevation illustrating the formation of a raised lip and nose along the peripheral edge of poured aggregate coping.
Figure 2:
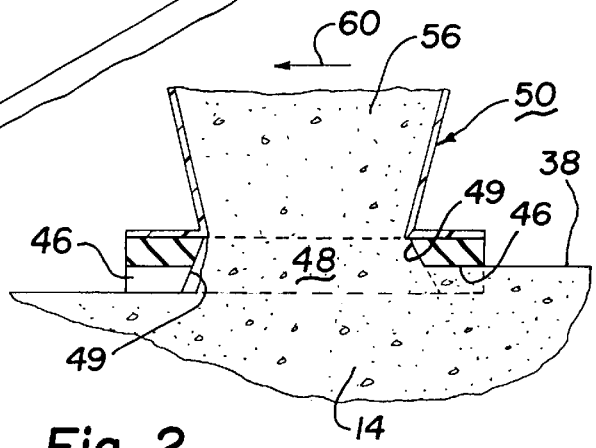
FIG. 2 is a fragmentary sectional elevation as seen substantially along the lines 2—2 of FIG. 1.
Figure 3:
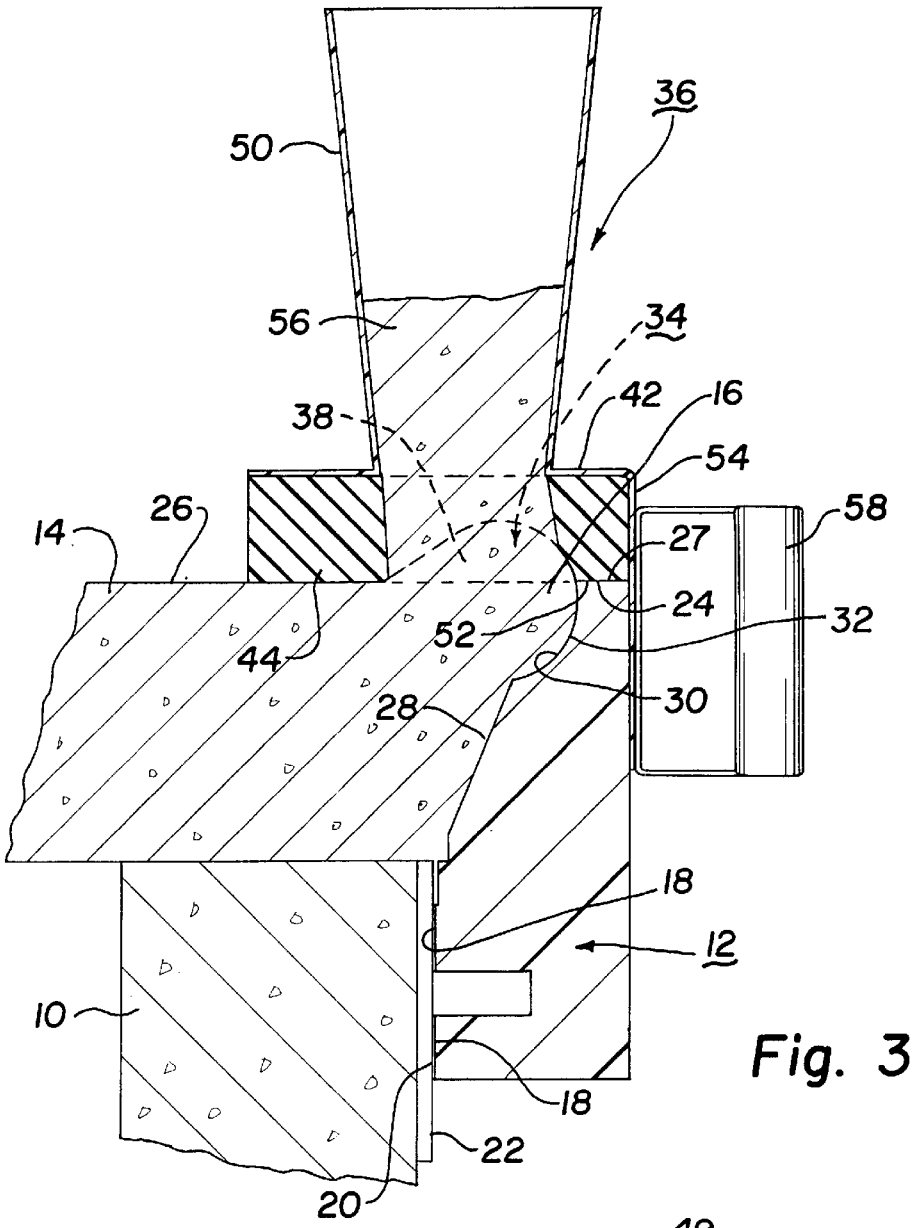
FIG. 3 is a sectional elevation as seen substantially along the lines 3—3 of FIG. 1.
Figure 4:
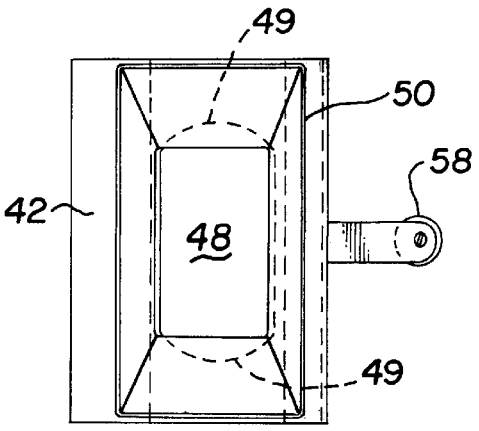
FIG. 4 is a top plan view of the mule of FIG. 1.
Figure 5:
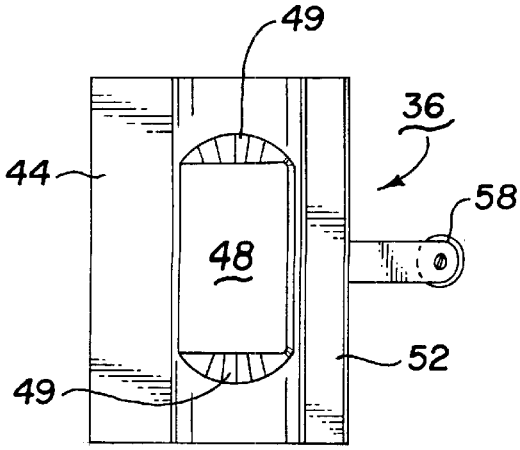
FIG. 5 is an underside plan view of the mule of FIG. 1.

In the description which follows, like parts are marked throughout the specification and drawings with the same reference numerals respectively. The drawing figures are not necessarily to scale and in certain views, proportions may have been exaggerated for purposes of clarity.

Referring now to FIGS. 1–5 of the drawings, there is illustrated a vertical pool wall 10 having tile 22 against which there is positioned a styrofoam form board 12 for shaping the cantilevered end face of uncured decking 14 including an integral coping 16. Form board 12 is preferably of the type disclosed in U.S. application Ser. No. 29/070,142 file May 1, 1997 and incorporated herein by reference. Included on form board 12 are parallel vertically spaced feet 18 on which double faced adhesive tape 20 secures the form in place against pool tile 22. Upper form edge 24 defines what would normally be the plane for upper surface 26 of decking 14. To form the canted face of cantilevered coping 36, form board 12 includes a vertically canted face 28 and at its upper edge includes a longitudinal concave recess 30 by which to form a nose projection 32. A strip of thin plastic tape 27 overlies edge 24 to protect and preserve the edge from the adverse effects of rodding and the use of mule 36 to be described.

Pouring the aggregate to form decking 14 and coping 16 as thus far described, results in an outwardly tapered end face on coping 16 complementing the profile of form board 12 and which at its upper edge contains a longitudinally extending convex nose or projection 32. Nose 32 when cured becomes the complementary underside of a gripping surface 34 to be described. For forming the top continuous and complementary portion of the gripping surface 34 (FIG. 2) there is utilized a metal mule 36 while the aggregate of coping 16 is still uncured, for depositing the upper convex strip or lip 38.

Comprising mule 36 is an angle shaped frame 39 of metal or plastic including a front plate 40 and a normally oriented top plate 42. Plate 40 is adapted on its inside surface to engage the back wall of form 12. Top plate 42, extends normal to front plate 40 and, contains on its underside a metal or hard rubber-like base 44 including a longitudinal concave recess 46. Communicating with the recess is a centrally located elongated opening 48 extending through plate 42 and base 44 that includes a discharge draft 49 at either end. Communicating with opening 48 from above plate 42 is an inwardly tapered vertical hopper 50 in which a quantity of uncured aggregate is placed for the forming of raised lip 38.

For utilizing mule 36, it is positioned as shown in FIG. 38. with the rear underside 52 of base 44 seated on plastic tape 27 over form edge 24. The inside face of front plate 40 engages the back face 54 of form 12 and a quantity of uncured aggregate 56 is placed in hopper 50. Handle 58 enables manual displacement of the mule gradually in the direction of arrow 60. In the course of displacement, aggregate 56 is dispensed outwardly through opening 48 to deposit on coping 16 in configuration conformance with the arcuate configuration of recess 46. This is continued until the entire longitudinal length of lip 38 is completed.

Figure 6:
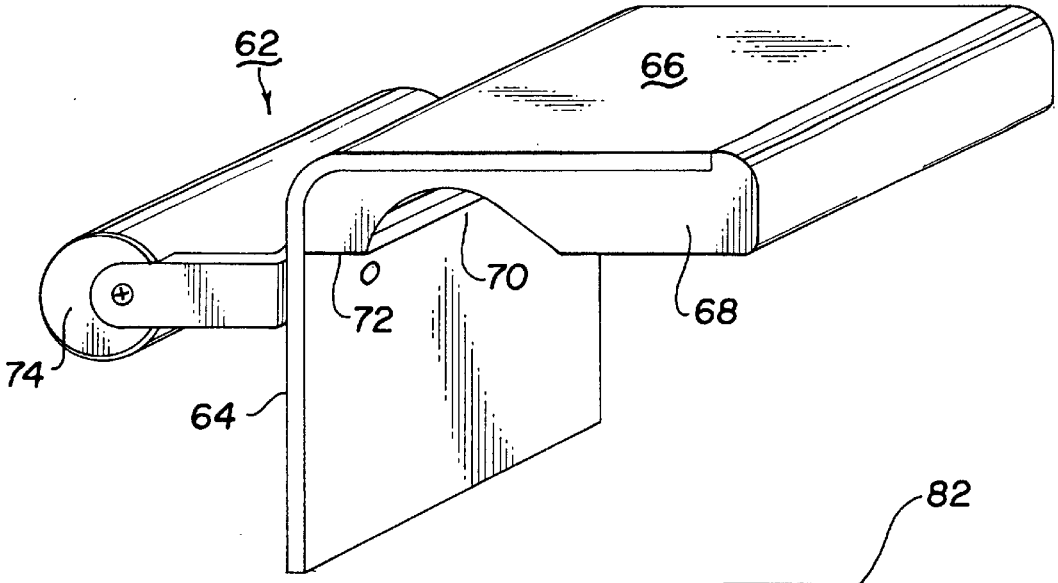
FIG. 6 is an isometric elevation of a troweling tool for floating the aggregate deposited by the mule of FIG. 1.
Figure 8:
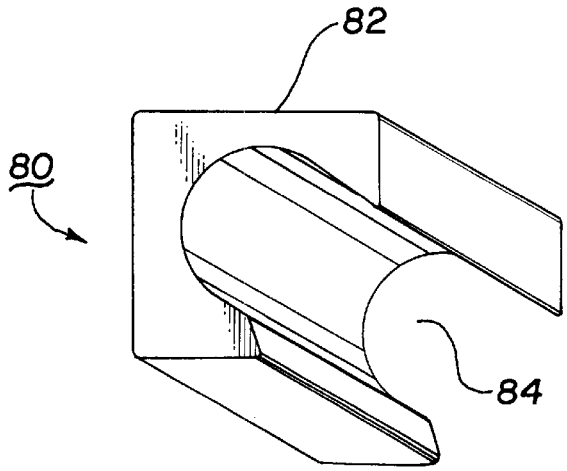
FIG. 8 is an isometric view of a finishing tool to provide a finished texture to the lip and nose surfaces created by the form board and deposited by the mule of FIG. 1.

Following behind the mule is a troweling tool 62 (FIG. 6) formed of right angle front and top plates 64 and 66 respectively with the top plate supporting a base 68 similar to base 44 including a like longitudinal recess 70 at its underside. As with mule 36, the inside of front plate 64 engages the rear face 54 of the form board while the underside 72 of base 68 is adapted to ride tape 27 on form board edge 24. Handle 74 is utilized for displacing troweling tool 62 whereby a float of previously deposited lip 38 is attained.

Figure 7:
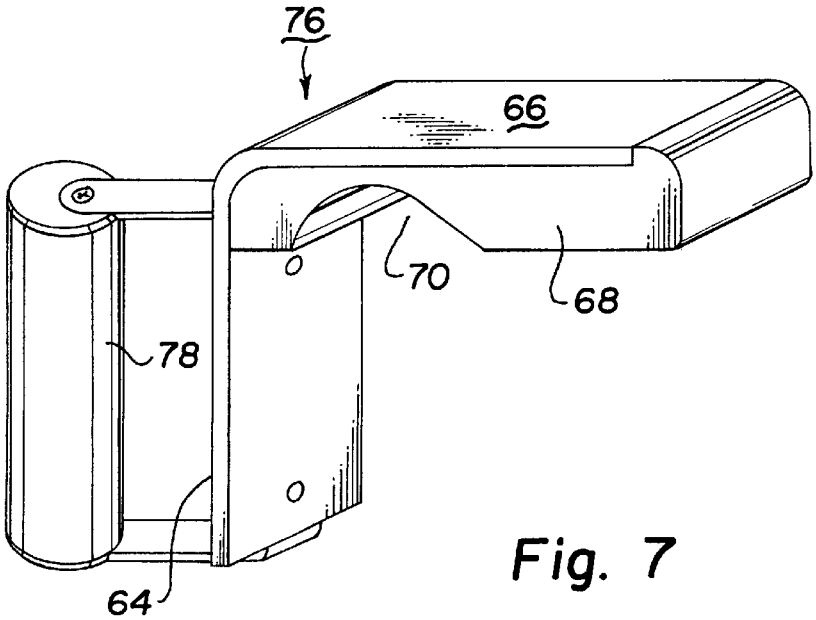
FIG. 7 is a tool similar to that of FIG. 6 for floating aggregate about sharp radii or corners.

FIG. 7 illustrates a second troweling tool 76 primarily useful for traversing curved portions of the coping and is of similar construction to troweling tool 62 except for the width of tool and the orientation of handle 78.

After depositing and floating the upper portion of lip 38, form board 12 is removed and a hard rubber finishing tool 80 is utilized to smooth out and combine upper lip 38 with lower nose 34 while enhancing their surface texture and eliminating any parting lines therebetween. For these purposes, tool 80 is comprised of a continuous hard-rubber base 82 containing an internally smooth longitudinal recess 84. The arcuate extent of recess 84 is sufficient to embody both nose 32 and lip 38 while eliminating a surface seam or parting line at the joinder thereof that might otherwise occur.

By the above description there is disclosed novel method and apparatus for effecting a raised gripping surface about the distal end of poured cantilevered coping extending about a swimming pool. In the manner hereof, there is enabled the construction of a horizontal nose, a vertical lip or a combination thereof affording a swimmer's grip particularly suitable for young children unable to swim or swim well. By means thereof there is afforded a simple yet inexpensive approach to constructing such a gripping surface that not only affords the virtue of an inexpensive aggregate construction but enables such construction to overcome previous legal prohibitions against use of poured on site aggregate coping.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A method of forming at least a portion of a raised gripping surface longitudinally extending locally about a peripheral coping face of a poured aggregate swimming pool coping, comprising the steps of:

a) providing a form board having a face configured to define a vertically oriented profile of the peripheral coping face, to be formed and including a longitudinal arcuate recess locally extending distinctly within the form board and of predetermined vertical dimension apart from a remainder of said defined vertically oriented profile conforming in complementary configuration to the portion of raised gripping surface to be formed thereat;

b) securing the form board with said face profile in a path of coping aggregate to be poured;

c) pouring the aggregate for said coping; and d) after curing said aggregate, removing said form board to reveal said raised gripping surface portion integral of and horizontally projecting locally outward beyond the peripheral face of said coping thereat.

2. A method of forming at least a portion of a raised gripping surface longitudinally extending about a peripheral edge of a poured aggregate swimming pool coping comprising the steps of:

a) providing a form board having a face configured to define a profile of a peripheral coping surface to be formed;

b) securing the form board with said face in the profile path of coping aggregate to be poured;

c) providing an aggregate dispensing mule displaceable longitudinally on the form board for dispensing and forming said raised gripping surface portion vertically raised from a horizontal surface of said coping;

d) pouring said coping aggregate; and e) longitudinally displacing said mule to dispense aggregate therefrom for forming said raised gripping surface portion longitudinally extending about the peripheral edge of said coping.

3. A method of forming a raised gripping surface longitudinally extending about a peripheral edge of a poured aggregate swimming pool coping, comprising the steps of:

a) providing a form board having a face configured to define a profile of a peripheral coping surface to be formed including a longitudinally extending arcuate recess in said face conforming in complementary configuration to a first portion of the gripping surface;

b) securing the form board with said face in the profile path of coping aggregate to be poured;

c) pouring said aggregate against said form board to provide said first portion of said gripping surface horizontally projecting from the peripheral edge of said coping;

d) providing an aggregate dispensing mule displaceable longitudinally on the form board for dispensing and shaping a second portion of said gripping surface contiguous to said first portion and vertically raised from a horizontal surface of said coping;

e) longitudinally displacing said mule while dispensing aggregate therefrom to provide said second portion of said gripping surface contiguous to said first portion and vertically raised from said horizontal surface of said coping; and f) removing said form board to reveal said first and second gripping surfaces in a combined relation.

4. The method in accordance with claim 3 including the added step of troweling said second gripping surface portion to effect a float thereof.

5. The method in accordance with claim 3 in which said first gripping surface portion comprises a nose extending outward beyond said coping to a distal face and horizontally along the peripheral edge of said coping periphery and said second gripping surface portion comprises a lip extending vertically from the horizontal surface of said coping.

6. The method in accordance with claim 5 including the added steps of:

providing a finishing tool having a concave longitudinal recess contained in an underside surface thereof conforming complementary to the combined profile of said lip and said nose; and after removing said form board longitudinally displacing said finishing tool along said lip and said nose so as to effect a continuous combined gripping surface thereof.

7. The method in accordance with claim 2 in which said step of providing a mule comprises providing a mule having a vertical hopper in which to receive a quantity of uncured aggregate to be dispensed onto uncured aggregate of said coping; and providing a quantity of uncured aggregate into said hopper.

8. A method of forming at least a portion of a raised gripping surface longitudinally extending about a peripheral edge of a poured aggregate swimming pool coping comprising the steps of:

a) providing a form board having a face configured to define a profile of a peripheral coping surface to be formed;

b) securing the form board with said face in the profile path of coping aggregate to be poured;

c) providing a displaceable form having an underside configuration complementing a configuration of the raised gripping surface portion to be formed;

d) pouring said coping aggregate; and e) longitudinally displacing said displaceable form on said form board and over said poured aggregate for forming said raised gripping surface portion vertically raised locally and continuous above a horizontal surface of said coping.

9. A method of forming a raised gripping surface longitudinally extending about a peripheral edge of a poured aggregate swimming pool coping, comprising the steps of:

a) providing a form board having a face configured to define a profile of a peripheral coping surface to be formed including a longitudinally extending arcuate recess in said face conforming in complementary configuration to a first portion of the gripping surface;

b) securing the form board with said face in the profile path of coping aggregate to be poured;

c) providing a displaceable form having an underside configuration complementing a configuration of a second portion of said gripping surface contiguous to said first portion and vertically raised from a horizontal surface of said coping;

d) pouring the aggregate for said coping against said form board to provide said first portion of said gripping surface horizontally projecting from the peripheral edge of said coping;

e) longitudinally displacing said displaceable form on said form board and over said poured aggregate for forming said second portion of said gripping surface; and f) removing said form board to reveal said first and second gripping surfaces in a combined relation.

* * * * *